US009154865B2

(12) United States Patent
Zha et al.

(10) Patent No.: US 9,154,865 B2
(45) Date of Patent: Oct. 6, 2015

(54) ACOUSTIC DEVICE

(71) Applicants: Yu-Bin Zha, Shenzhen (CN); Xiong Zhang, Shenzhen (CN)

(72) Inventors: Yu-Bin Zha, Shenzhen (CN); Xiong Zhang, Shenzhen (CN)

(73) Assignees: AAC Microtech (changzhou) Co., Ltd., Changzhou (CN); AAC Acoustic Technologies (shenzhen) Co., Ltd., Shenzhen (CN)

( * ) Notice: Subject to any disclaimer, the term of this patent is extended or adjusted under 35 U.S.C. 154(b) by 78 days.

(21) Appl. No.: 13/975,685

(22) Filed: Aug. 26, 2013

(65) Prior Publication Data

US 2014/0133684 A1 May 15, 2014

(30) Foreign Application Priority Data

Nov. 15, 2012 (CN) ..... 2012 2 0601490 U

(51) Int. Cl.

*H04R 1/28* (2006.01)
*H04R 1/02* (2006.01)
*H04R 1/30* (2006.01)

(52) U.S. Cl.

CPC ..... *H04R 1/021* (2013.01); *H04R 1/2803* (2013.01); *H04R 1/2811* (2013.01); *H04R 1/30* (2013.01); *H04R 2499/11* (2013.01)

(58) Field of Classification Search

CPC . H04R 1/2842; H04R 1/2857; H04R 2499/11
USPC ..... 379/433.02
See application file for complete search history.

(56) References Cited

U.S. PATENT DOCUMENTS

| | | | | |
|---|---|---|---|---|
| 6,526,150 | B2 * | 2/2003 | Kelly et al. | 381/353 |
| 6,834,181 | B2 * | 12/2004 | Kaikuranta et al. | 455/90.3 |
| 7,369,673 | B2 * | 5/2008 | Matsumoto et al. | 381/386 |
| 7,556,121 | B2 * | 7/2009 | Yang et al. | 181/145 |
| 7,894,620 | B2 * | 2/2011 | Yang | 381/345 |
| 8,259,985 | B2 * | 9/2012 | Yang et al. | 381/386 |
| 8,351,631 | B2 * | 1/2013 | Lee et al. | 381/338 |
| 8,838,189 | B2 * | 9/2014 | Andersen et al. | 455/575.1 |
| 2004/0170291 | A1 * | 9/2004 | Eaton | 381/334 |
| 2013/0094685 | A1 * | 4/2013 | Seo et al. | 381/332 |
| 2014/0177902 | A1 * | 6/2014 | Yeh | 381/394 |

* cited by examiner

*Primary Examiner* — Curtis Kuntz
*Assistant Examiner* — Ryan Robinson
(74) *Attorney, Agent, or Firm* — IPro, Inc.; Na Xu

(57) ABSTRACT

One embodiment of the invention discloses an acoustic device having a housing and a speaker unit accommodated in the housing. The speaker unit forms a front volume and a back volume together with the housing. The housing includes an extra volume communicating with the back volume and a sound channel communicated with the front volume. The extra volume is isolated from the sound channel. The invention provides an acoustic device with enlarged back volume for improving low frequency sound quality.

8 Claims, 7 Drawing Sheets

ACOUSTIC DEVICE

FIELD OF THE INVENTION

One embodiment of the invention is related to an acoustic device, and more particularly to a speaker box having an enlarged back volume.

DESCRIPTION OF RELATED ART

In modern consumer electronics, audio capability is playing an increasingly larger role as improvements in digital audio signal processing and audio content delivery continue to happen. There is a range of consumer electronics devices that are not dedicated or specialized audio playback devices, yet can benefit from improved audio performance. For instance, smart phones are ubiquitous.

In a typical acoustic device, such as a speaker or a speaker box, a sound radiation surface is provided for generating sound. Generally, the sound radiation surface is a membrane or a diaphragm which is activated by an electrified voice coil. While activated, the sound radiation surface vibrates and produces audible sounds. Basically, the space or the volume in which the sound from the front face of the sound radiation surface travels to an acoustic output port of the acoustic device is called a front volume. And the space or the volume behind the sound radiation surface or behind the acoustic device is called a back volume. The back volume affects a low frequency sound quality of the acoustic device.

A speaker box 1 related to the present invention is illustrated in FIGS. 1-2. The speaker 1 includes an upper cover 11, a base 14, a lower cover 13 forming a cavity 12 cooperatively with the upper cover 11 and the base 14, and a speaker unit 15 accommodated in the cavity 12. The base 14 further includes a frame 141 dividing the cavity 12 into a front volume 121 which is in front of the speaker unit 15 and a back volume 123 which is behind the speaker unit 15. In addition, the speaker box 1 includes a sound channel 125 communicating with the front volume 121. According to the configuration the related speaker box, the front volume together with the sound channel is much larger than the back volume. The smaller back volume badly affects the low frequency sound quality of the acoustic device.

Therefore, an improved acoustic device is provided in the embodiment of the present disclosure to solve the problem mentioned above.

Figure 1:
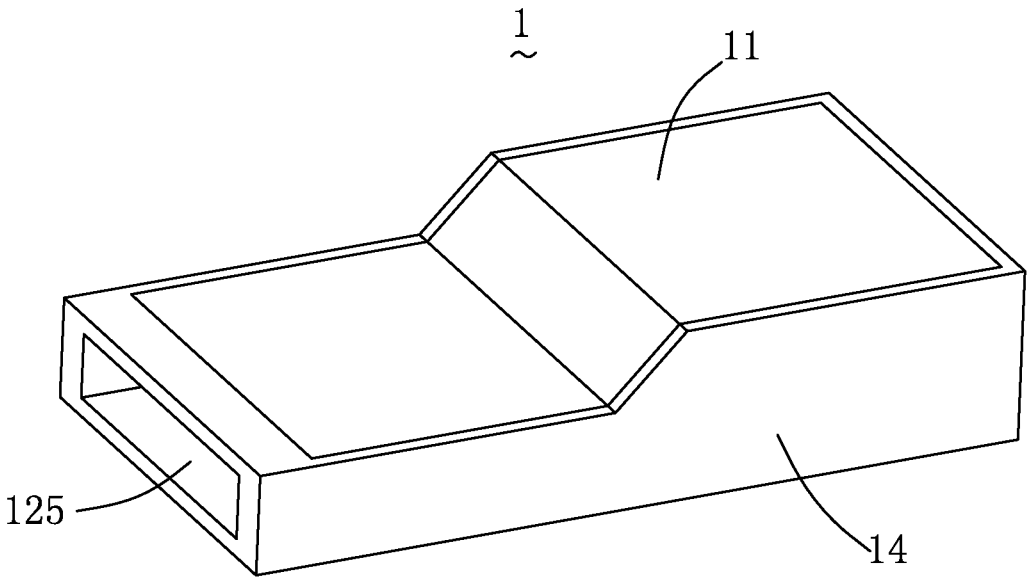
Fig. 1 (Related Art)
FIG. 1 is an illustrative isometric view of a speaker box related to the present invention.
Figure 2:
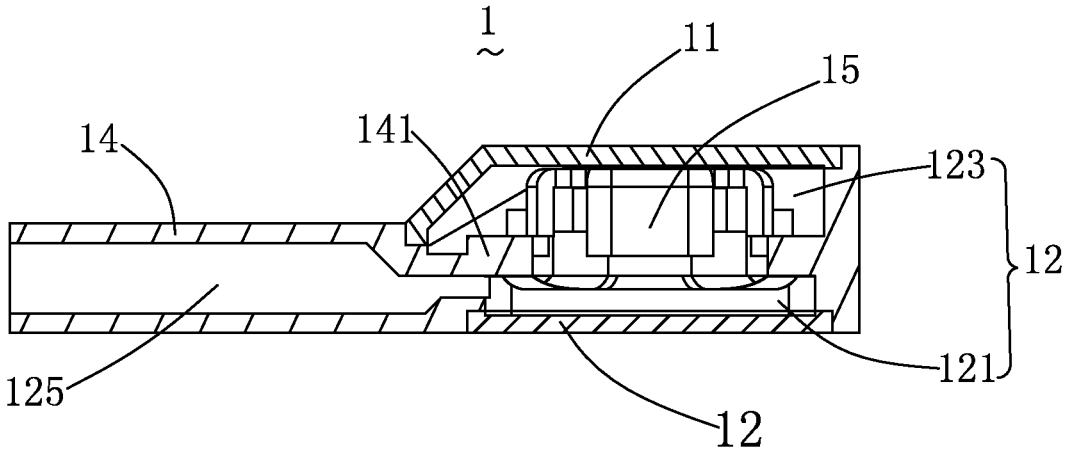
Fig. 2 (Related Art)
FIG. 2 is a cross-sectional view of the speaker box in FIG. 1.

Many aspects of the embodiments can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Reference will now be made to describe exemplary embodiments of the present invention in detail. In this section we shall explain several exemplary embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 3:
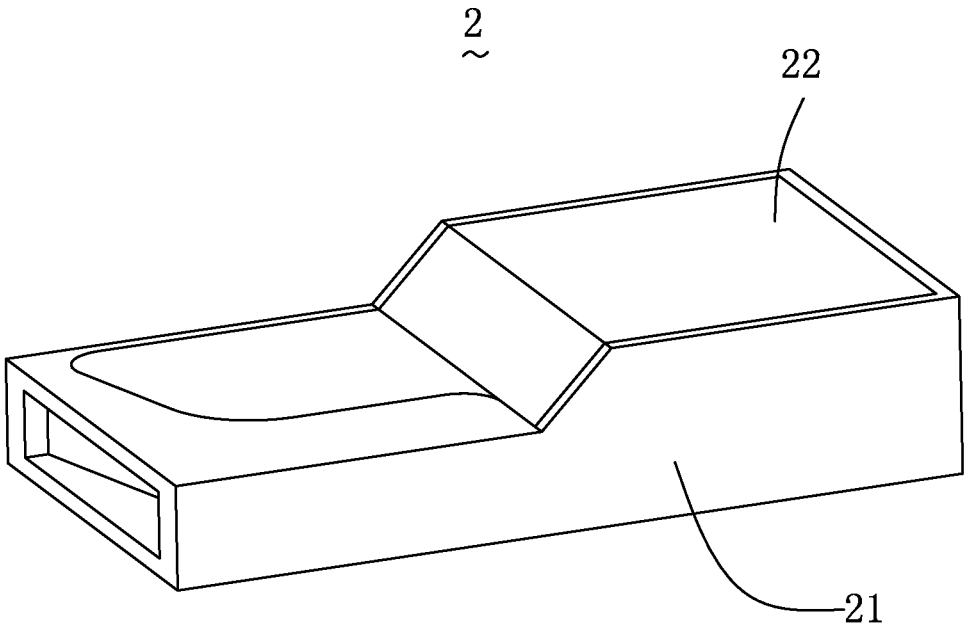
FIG. 3 is an illustrative isometric view of an acoustic device in accordance with a first embodiment of the present invention.
Figure 4:
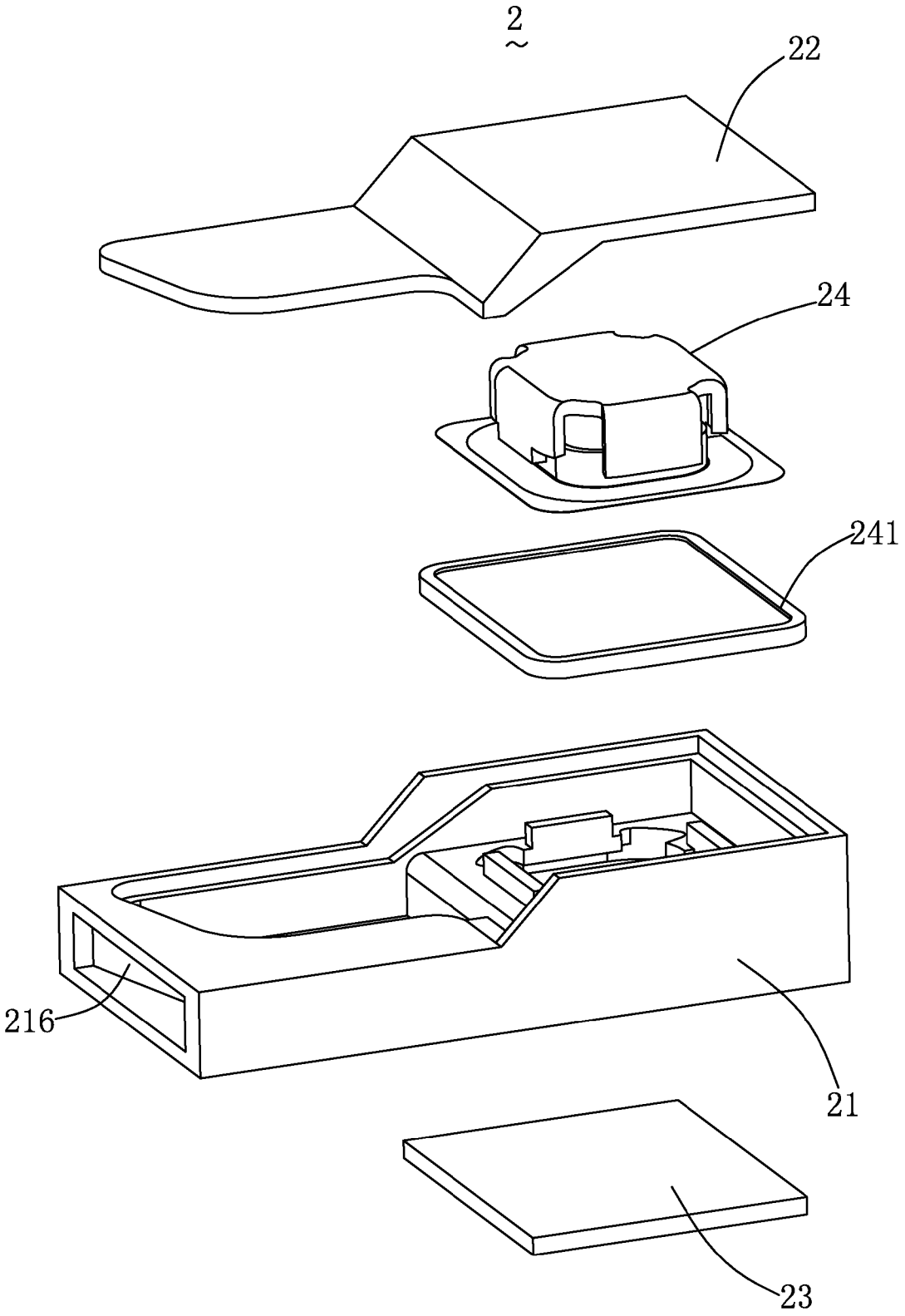
FIG. 4 is an exploded view of the acoustic device in FIG. 3.

Referring to FIGS. 3-4, an acoustic device 2 in accordance with a first embodiment of the invention is illustrated. The acoustic device 2 includes a base 21 having two entrances, a top cover 22 assembled with the base 21 for covering one of the entrances, a lower cover 23 assembled with the base 21 for covering the other entrance, and a speaker unit 24 fixed and received in a space formed by the base 21, the top cover 22, and the lower cover 23. A ring-shaped frame 241 is provided for positioning the speaker unit 24 in the base 21. The frame 241 is an optional component in this embodiment, and the speaker unit 24 could be positioned by other public-known ways. The base 21, the top cover 22, and the lower cover 23 cooperatively form a housing which includes the space for accommodating the speaker unit 24 therein. In this embodiment, the base 21, the top cover 22 and the lower cover 23 are three separated components, but in other alternative embodiments, each of the three components could be integrated with another one. This invention is not restricted to the amount or the shape of each of the components which are used to form the housing, as long as a housing is provided for accommodating the speaker unit 24. The speaker unit 24 includes a sound radiation surface 242 which is attached to the frame 241 by which the speaker unit 24 is connected with the frame 241. In this embodiment, the sound radiation surface 242 is a membrane or a diaphragm. In an alternative embodiment, the sound radiation surface 242 may be a piezoelectric plate, a metal plate, or any other component being capable of vibrating to generate sound.

Figure 5:
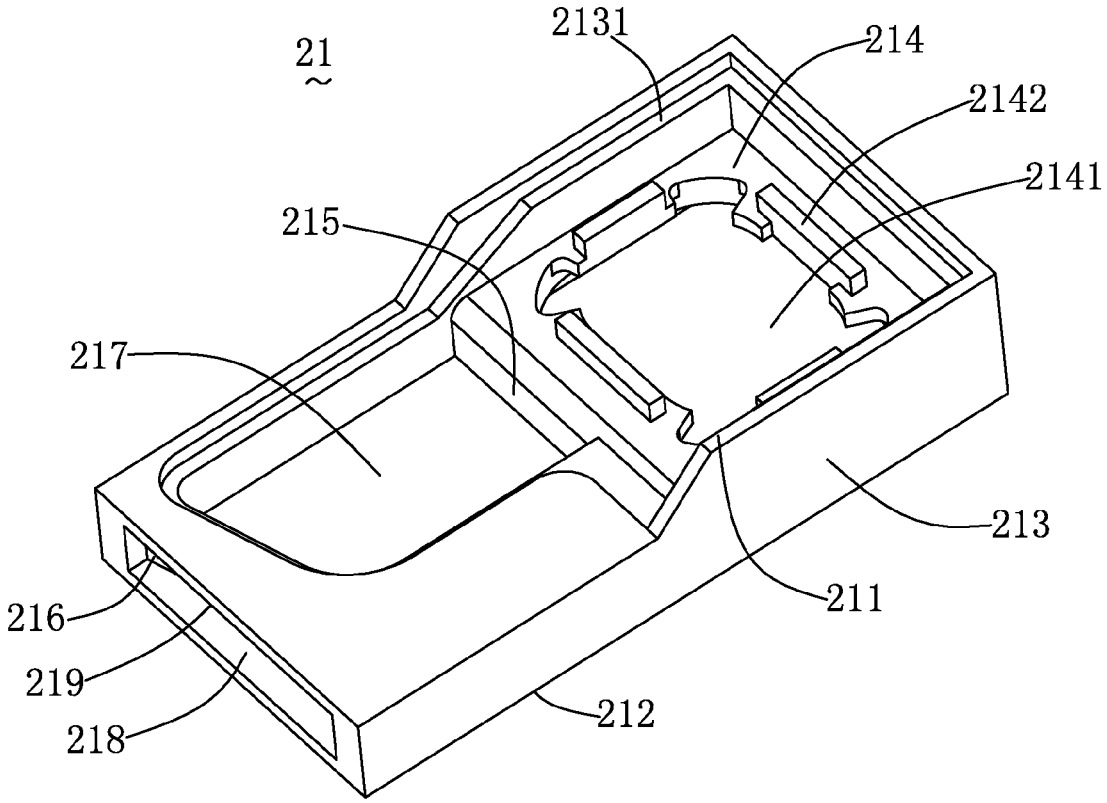
FIG. 5 is an isometric view of a base used in the acoustic device in FIG. 3.
Figure 6:
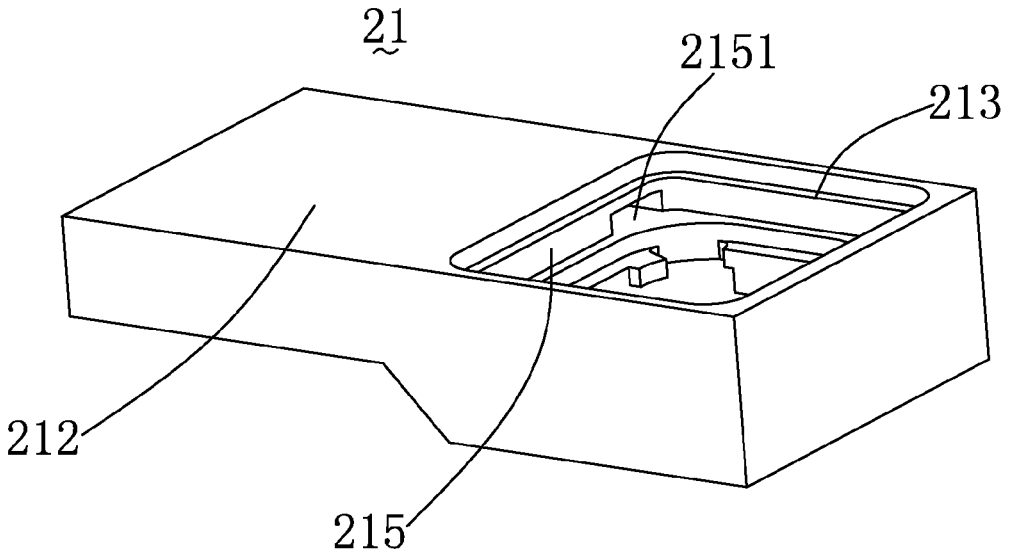
FIG. 6 is an isometric view of the base in FIG. 5, but from another aspect.

Referring to FIG. 5, which is an isometric view of the base 21, the base 21 includes a top wall 211, a bottom wall 212 parallel and opposed to the top wall 211, and a plurality of sidewalls 213 connecting the top wall 211 to the bottom wall 212. One of the entrances mentioned above is formed in the top wall 211 of the base 21, and another entrance is formed in the bottom wall 212 (as shown in FIG. 6). The base 21 forms a space surrounded by the top wall 211, the bottom wall 212 and the sidewalls 213. The base 21 further includes a mounting plate 214 arranged in the space and supported by the sidewalls 213 at a position between the top wall 211 and the bottom wall 212. Accordingly, the space is divided into two parts, one being between the top wall 211 and the mounting plate 214, another being between the mounting plate 214 and the bottom wall 212. The mounting plate 214 includes an opening 2141 formed in a middle portion thereof and a plurality of fixing members 2142 close to the opening 2141. In this embodiment, the mounting plate is configured to be a plate with an opening, and edges of the mounting plate are connected to sidewalls of the base. The configuration of the mounting plate is used to support or fix the speaker unit, so, in fact, the mounting plate may be configured to be any shape. For example, the mounting plate may be a flange extending from the sidewall of the housing, or a plurality of wedding points for fixing the speaker unit to the sidewalls of the housing.

Figure 9:
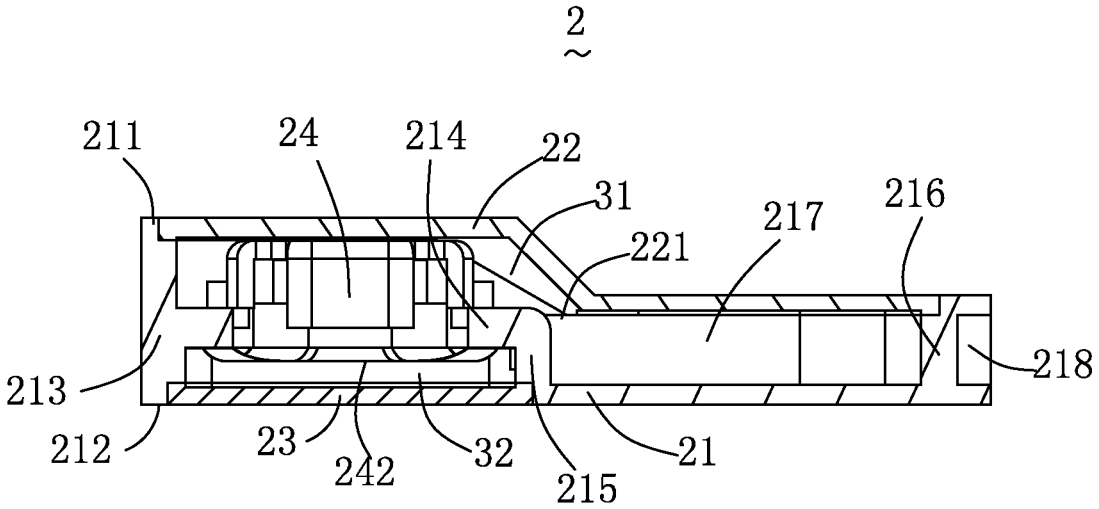
FIG. 9 is a cross-sectional view of the acoustic device, taken along the line A-A in FIG. 8.

Referring to FIGS. 4-5, the speaker unit 24 is mounted on the mounting plate 214 with the sound radiation surface 242 covering the opening 214, and the speaker unit 24 is fixed in position by the cooperation between the frame 241 and the fixing members 2142. Specifically, an inner side of the frame 241 abuts against an outer side of the fixing member 2142. While the speaker unit 24 is positioned on the mounting plate 214, the space between the top wall 211 and the mounting plate 214 is isolated from the space between the mounting plate 214 and the bottom wall 212 by the sound radiation surface 242. We now define the space between the top wall 211 and the mounting plate 214 as a back volume 31, and define the space between the mounting plate 214 and the bottom wall 212 as a front volume 32, as shown in FIG. 9. In FIG. 9, the front volume 32 is formed cooperatively by the mounting plate 214, the inner wall 215, the lower cover 23, and the sidewalls 213 which connect with the mounting plate 214.

Referring back to FIGS. 4-5, the base 21 further includes an inner wall 215 extending from an edge of the mounting plate 214 to the bottom wall 212. In addition, the base 21 includes a barrier 216 extending from the top wall 211 to the bottom wall 212. One end of the barrier 216 connects to one of the sidewalls 213 of the base 21, and the other end of the barrier 216 connects to the inner wall 215. An extra volume 217 is accordingly formed by the inner wall 215, one side wall adjacent to the inner wall 215, and the barrier 216. And, a sound channel 218 is accordingly formed by the inner wall 215, another side wall adjacent to the inner wall 215, the barrier 216, and one side wall parallel to the inner wall 215. The side wall forming the sound channel includes a sound aperture 219 communicating the sound channel 218 to the outside of the base 21. The sidewall 213 of the base further forms a rib 2131 for supporting the top cover 22. When engaged with the base 21, the top cover 22 is supported by the rib 2131 and is coplanar with the top wall 211 of the base 21.

Referring to FIGS. 4-6, which is another isometric view of the base 21 form another aspect, the inner wall 215 defines a through window 2151 communicating with the sound channel 218. Again, the lower cover 23 engages with the base 21 by being supported by the rib 213, and when engaged, the lower cover 23 is coplanar with the bottom wall 212.

Figure 7:
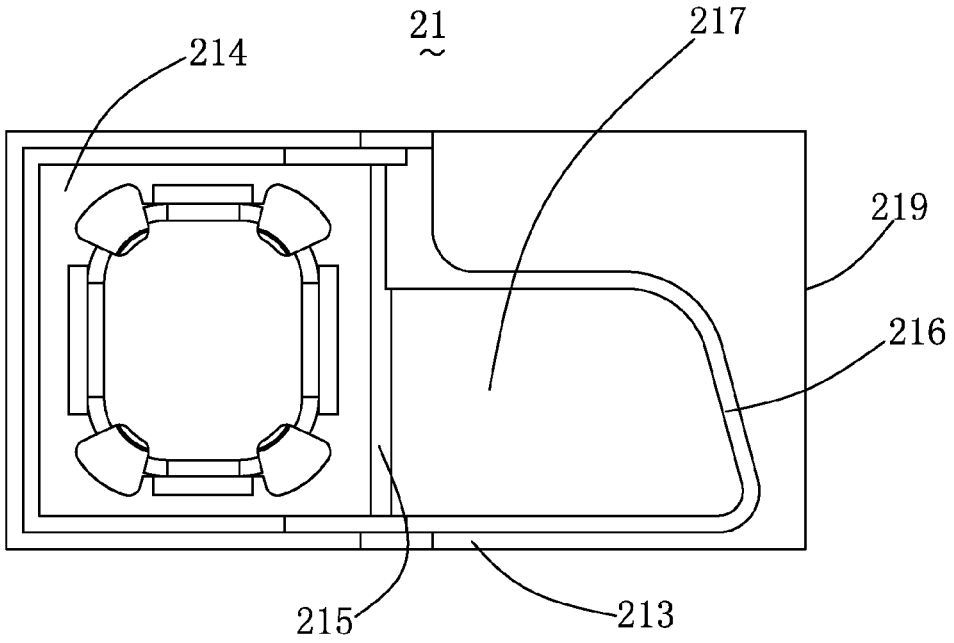
FIG. 7 is a top view of the base in FIG. 5.

Referring to FIG. 7, the extra volume 217 is bounded by the barrier 216, one sidewall adjacent to the inner wall 215, and the inner wall 215. The extra volume 217 communicates with the space above the mounting plate, and is isolated from the sound aperture 219. As shown in FIG. 9, the space above the mounting plate is defined as the back volume 31.

Figure 8:
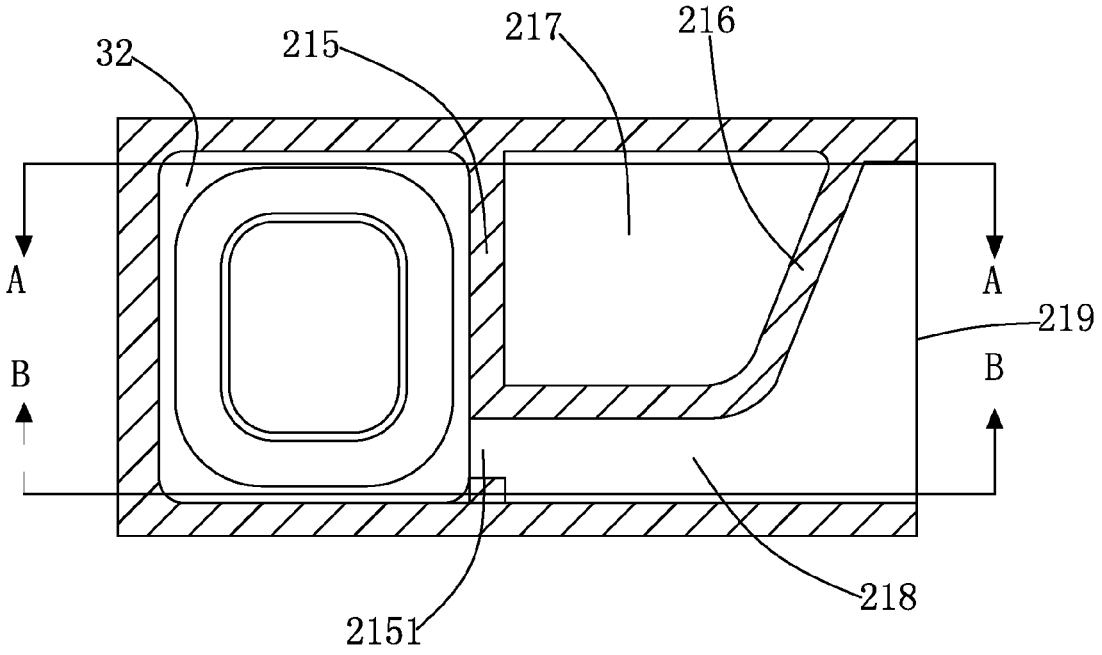
FIG. 8 is bottom view of the acoustic device in FIG. 1, a bottom wall of the base in FIG. 5 being removed.

Referring to FIGS. 8-9, the sound channel 218 communicates with the front volume 32 via the through window 2151 in the inner wall 215 and communicates with the sound aperture 219. The extra volume 217 is isolated from the sound channel 218 by the barrier 216.

Referring to FIG. 9, which shows a cross-sectional view of the acoustic device 2, the top cover 22 engages the base 21 for covering one port of the base 21, and the lower cover 23 engages with the base 21 for covering another port of the base 21. The top cover 22, the base 21, and the lower cover 23 cooperatively form the housing. While assembled, the top cover 22 is coplanar with the top wall 211 of the base 21, and the lower cover 23 is coplanar with the bottom wall 212 of the base 21. The speaker unit 24 is mounted on and supported by the mounting plate 214, with the sound radiation surface 242 received in the front volume 32, and other part of the speaker unit 24 received in the back volume 31. While the top cover 22 engages with the base 21, a gap 221 is formed between the top cover 22 and the inner wall 215 for communicating the back volume 31 with the extra volume 217. The extra volume 217 is isolated from the sound channel 218 by the barrier 216. As the back volume 31 communicates with the extra volume 217, the back volume 31 is indeed enlarged, which could improve the low frequency sound quality. Compared with the related art, in fact, the back volume 31 is enlarged by obtaining some space from the sound channel by virtue of the barrier 216.

In this embodiment, the top cover and the lower cover are separated from the base. In fact, the top cover may be construed as a part of the top wall of the base, and the lower cover may be construed as a part of the bottom wall of the base. In FIG. 9, it is shown that the top cover has a higher part and a lower part for cooperating with the base also having a higher part and a lower part, which is just an exemplary embodiment of the invention. In other embodiment, the top cover may be a flat plate, and the base may be a rectangular box. The shapes of the base and the cover are not limited to the illustration in FIG. 9, and any other configuration is feasible to enlarge the back volume, as long as the back volume communicates with the extra volume, and the extra volume is isolated from the sound channel.

Figure 10:
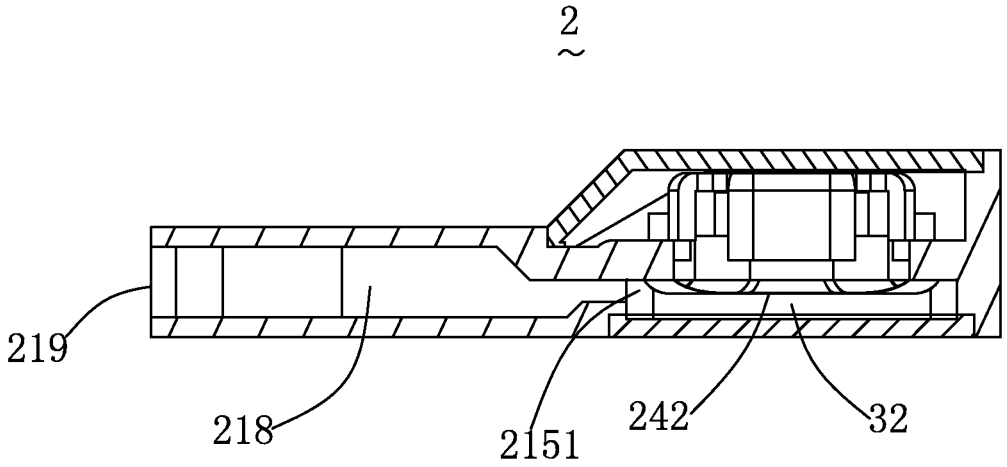
FIG. 10 is a cross-sectional view of the acoustic device, taken along the line B-B in FIG. 8.

Referring to FIG. 10, which is another cross-sectional view of the acoustic device 2, it is clearly illustrated that the front volume 32 is communicated with the sound channel 218 via the through window 2151. Sound waves produced by the sound radiation surface 242 pass the front volume 32 to the sound channel via the through window 2151 and finally transmit to the outside of the acoustic device 2 via the sound aperture 219.

Figure 11:
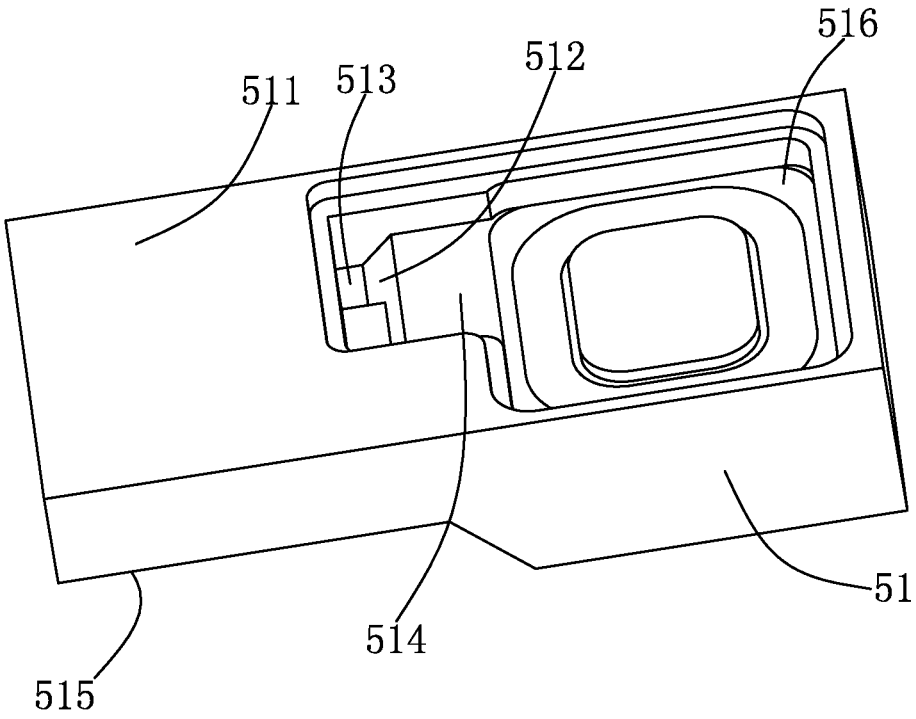
FIG. 11 is an illustrative isometric view of an acoustic device in accordance with a second embodiment of the present invention, a lower cover thereof being removed.

Referring to FIG. 11, which is an isometric view of a base 51 in accordance with another exemplary embodiment of the present invention, compared with the embodiment set forth above, the inner wall 512 extends from the mounting plate 514 to the top wall 515 but keeps a distance from the bottom wall 511 for forming an interval 513 for communicating the front volume 516 with the sound channel.

Regarding the front volume and the back volume as described in the embodiments above, we use the mounting plate to define the two volumes. In fact, the volumes could also be defined by the sound radiation surface. Basically, we can also define the space in which the sound from the front face of the sound radiation surface travels to an acoustic output port of the acoustic device is called a front volume. And the space behind the sound radiation surface or behind the acoustic device is called a back volume. Another word, even if no mounting plate is provided, the front volume and the back volume still exist, and the two volumes are separated from each other by the sound radiation surface.

The embodiments described above indeed disclose one common configuration of an acoustic device, which could be described from another aspect, as follows.

An acoustic device includes a housing, and a speaker unit accommodated in the housing. The speaker unit includes a sound radiation surface for generating sound and transmitting the sound to a sound output port formed in the housing. The housing includes a top wall, a bottom wall, and a plurality of sidewalls connecting the top wall to the bottom wall. A space is accordingly formed by the walls of the housing. The housing further includes an inner wall extending from the bottom wall in the space for dividing the space into a first space and a second space. The speaker unit is received in the first space. A mounting plate is provided in the first space for suspending the speaker unit in the first space. A front volume is formed between the sound radiation surface and the bottom wall, or between the mounting plate and the bottom wall. A back volume is formed between the top wall and the sound radiation surface, or between the top wall and the mounting plate. A barrier is provided in the second space for dividing the second space into an extra volume communicating with the back volume and a sound channel communicating with the sound output port. The extra volume is isolated from the sound channel.

While the present disclosure has been described with reference to the specific embodiments, the description of the disclosure is illustrative and is not to be construed as limiting the disclosure. Various of modifications to the present disclosure can be made to the exemplary embodiments by those skilled in the art without departing from the true spirit and scope of the disclosure as defined by the appended claims.

What is claimed is:

1. An acoustic device, comprising:

a housing having a top wall, a bottom wall, and a plurality of sidewalls cooperatively forming a space with the top and bottom walls;

a mounting plate positioned in the space with edges thereof connecting to the sidewalls;

a speaker unit mounted on the mounting plate, the speaker unit having a sound radiation surface;

an inner wall extending from the mounting plate to the bottom wall for partitioning the space into a first space for receiving the mounting plate and a second space;

a first volume formed between the top wall and the mounting plate;

a second volume formed by the mounting plate, the inner wall, the bottom wall and the sidewalls connecting with the mounting plate, the sound radiation surface being capable of vibrating in the second volume;

a barrier located in the second space for dividing the second space into an extra volume communicating with the first volume, and a sound channel communicating with the second volume;

the extra volume being isolated from the sound channel, and the sound channel transmitting sounds from the sound radiation surface to outside of the acoustic device via a sound aperture formed in the housing.

2. The acoustic device as described in claim 1, wherein the housing includes a base, a top cover covering one side of the base, and a lower cover covering another side of the base.

3. The acoustic device as described in claim 2, wherein the top cover is a part of the top wall of the housing, and the lower cover is a part of the bottom wall of the housing.

4. The acoustic device as described in claim 1, wherein the mounting plate forms an opening for fixing the speaker unit.

5. The acoustic device as described in claim 4, wherein the speaker unit includes a frame, and the mounting plate includes a plurality of fixing members around the opening for cooperating with the frame for fixing the speaker unit.

6. The acoustic device as described in claim 1, wherein the inner wall forms a through window for communicating the second volume with the sound channel.

7. The acoustic device as described in claim 1, wherein the inner wall keeps a distance from the bottom wall for forming an interval to communicate the second volume with the sound channel.

8. The acoustic device as described in claim 1, wherein the top wall of the housing and the inner wall form a gap therebetween for communicating the extra volume with the first volume.

* * * * *